US010371351B2

(12) United States Patent
Wu

(10) Patent No.: US 10,371,351 B2
(45) Date of Patent: Aug. 6, 2019

(54) ILLUMINATION DEVICE

(71) Applicants: LITE-ON ELECTRONICS (GUANGZHOU) LIMITED, Guangzhou (CN); LITE-ON TECHNOLOGY CORPORATION, Taipei (TW)

(72) Inventor: Bing-Yu Wu, Taipei (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 0 days.

(21) Appl. No.: 15/599,609

(22) Filed: May 19, 2017

(65) Prior Publication Data

US 2018/0128449 A1 May 10, 2018

(30) Foreign Application Priority Data

Nov. 4, 2016 (TW) ..... 105135931 A

(51) Int. Cl.

| | |
|---|---|
| ***F21V 7/09*** | (2006.01) |
| ***F21V 7/00*** | (2006.01) |
| ***F21S 8/04*** | (2006.01) |
| ***F21V 7/04*** | (2006.01) |
| ***F21V 7/05*** | (2006.01) |
| ***F21V 23/00*** | (2015.01) |
| ***F21V 29/503*** | (2015.01) |
| *F21Y 109/00* | (2016.01) |
| *F21Y 115/10* | (2016.01) |

(52) U.S. Cl.

CPC ..... *F21V 7/0083* (2013.01); *F21S 8/046* (2013.01); *F21V 7/0008* (2013.01); *F21V 7/0025* (2013.01); *F21V 7/04* (2013.01); *F21V 7/05* (2013.01); *F21V 23/009* (2013.01); *F21V 29/503* (2015.01); *F21V 7/0058* (2013.01); *F21Y 2109/00* (2016.08); *F21Y 2115/10* (2016.08)

(58) Field of Classification Search

CPC ..... F21V 7/0025; F21V 7/0058; F21V 7/0083
USPC ..... 362/300, 297
See application file for complete search history.

(56) References Cited

U.S. PATENT DOCUMENTS

| | | | | |
|---|---|---|---|---|
| 1,583,216 A * | 5/1926 | Wompey | F21S 41/162 | 362/302 |
| 7,726,848 B2 * | 6/2010 | Lai | F21V 31/04 | 362/298 |
| 2004/0042212 A1 * | 3/2004 | Du | F21S 8/02 | 362/296.04 |
| 2004/0114366 A1 * | 6/2004 | Smith | F21S 48/328 | 362/247 |
| 2008/0285295 A1 * | 11/2008 | Schug | F21S 41/24 | 362/487 |

(Continued)

*Primary Examiner* — Christopher M Raabe
(74) *Attorney, Agent, or Firm* — McClure, Qualey & Rodack, LLP

(57) ABSTRACT

An illumination device including an upper casing, a transparent bottom casing, a light source module and a reflection layer is provided. The upper casing has a lower surface. The transparent bottom casing has an upper surface. The light source module is disposed on the lower surface of the upper casing. The reflection layer is extended between the upper surface of the transparent bottom casing and the lower surface of the upper casing for reflecting the light emitted by the light source module.

11 Claims, 2 Drawing Sheets

(56) References Cited

U.S. PATENT DOCUMENTS

2013/0003352 A1* 1/2013 Lee ..... G02B 6/0096
362/97.1
2013/0223079 A1* 8/2013 Jung ..... F21S 8/02
362/297

* cited by examiner

ILLUMINATION DEVICE

This application claims the benefit of Taiwan application Serial No. 105135931, filed Nov. 4, 2016, the subject matter of which is incorporated herein by reference.

BACKGROUND OF THE INVENTION

Field of the Invention

The invention relates in general to an illumination device, and more particularly to an illumination device having a reflection layer.

Description of the Related Art

During illumination, conventional illumination devices will generate a high heat, which will affect the lifespan of the elements of the illumination devices. Normally, the light sources of the illumination devices are disposed at the bottom of the illumination devices. Although such design allows the light to be directly outputted from the bottom, heat dissipation becomes more difficult, and affects the lifespan of the illumination devices. Therefore, it has become a prominent task for the industry to provide a new technology for resolving the said problems.

SUMMARY OF THE INVENTION

The invention is directed to an illumination device capable of resolving the generally known problems disclosed above.

According to one embodiment of the present invention, an illumination device including an upper casing, a transparent bottom casing, a light source module and a reflection layer is provided. The upper casing has a lower surface. The transparent bottom casing has an upper surface. The light source module is disposed on the lower surface of the upper casing. The reflection layer is extended between the upper surface of the transparent bottom casing and the lower surface of the upper casing for reflecting the light emitted by the light source module.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
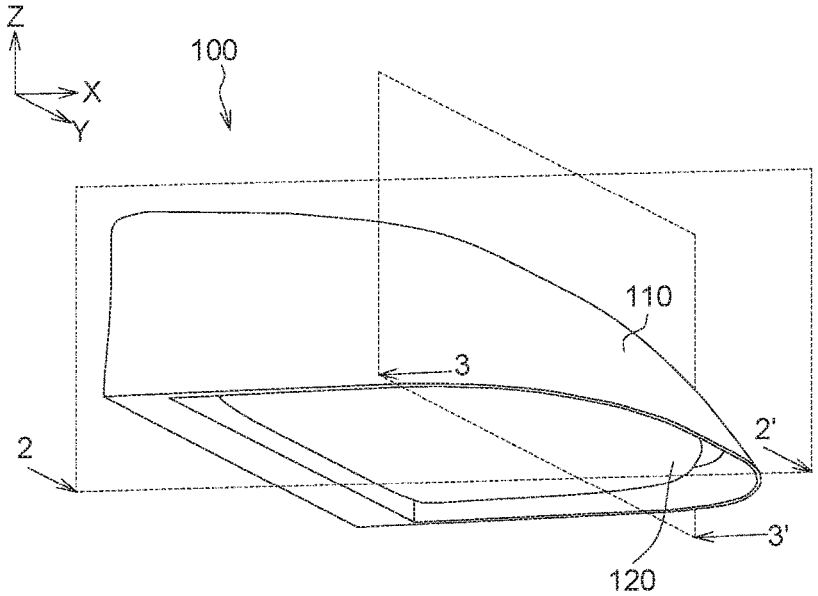
FIG. 1 is a schematic view of an illumination device according to an embodiment of the invention.
Figure 2:
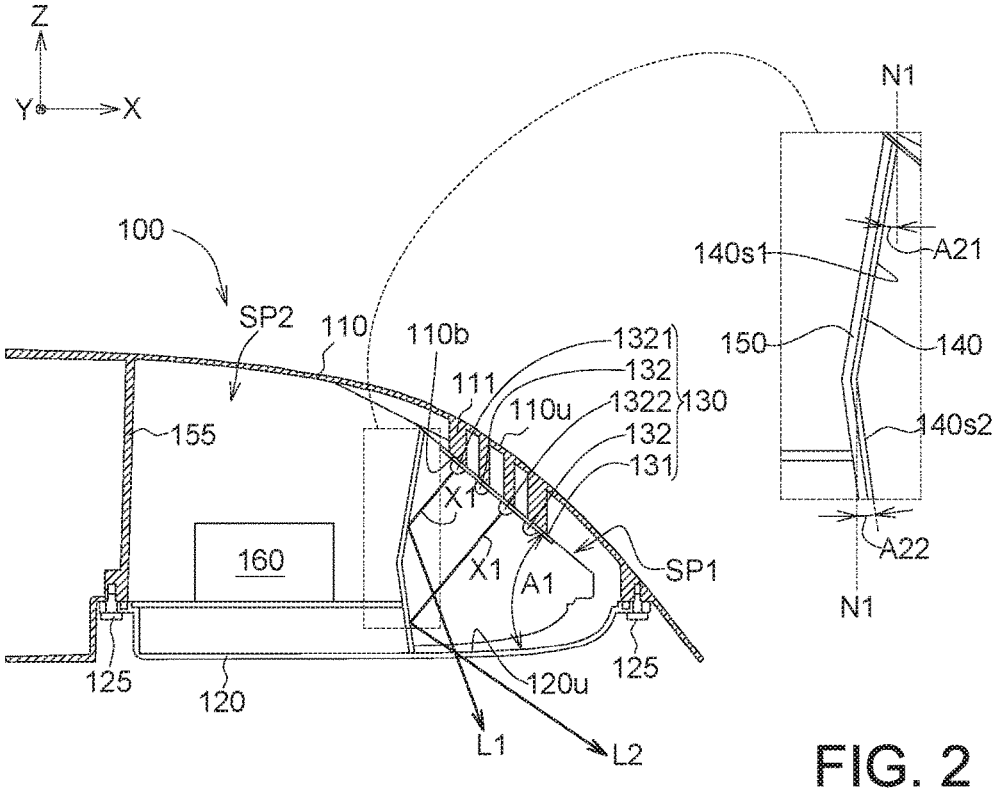
FIG. 2 is a cross-sectional view of the illumination device of FIG. 1 along a direction 2-2'.

Refer to FIGS. 1 and 2. FIG. 1 is a schematic view of an illumination device 100 according to an embodiment of the invention. FIG. 2 is a cross-sectional view of the illumination device 100 of FIG. 1 along a direction 2-2'. The illumination device 100 can be realized by such as a street lamp, a table lamp, a chandelier or other lighting fixtures.

As indicated in FIG. 2, the illumination device 100 includes an upper casing 110, a transparent bottom casing 120, a light source module 130, a first reflection layer 140, an inner board 150, a rear casing 155 and a control module 160. The upper casing 110 has a lower surface 110*b*. The transparent bottom casing 120 has an upper surface 120*u*. The light source module 130 is disposed on the lower surface 110*b* of the upper casing 110. The first reflection layer 140 is extended between the lower surface 110*b* of the upper casing 110 and the upper surface 120*u* of the transparent bottom casing 120 for reflecting the lights L1 and L2 emitted by the light source module 130 to the transparent bottom casing 120. The reflected lights L1 and L2 are further outputted from the transparent bottom casing 120. The transparent bottom casing 120 can be realized by such as a lens for refracting the lights L1 and L2 emitted by the light source module 130 to produce a predetermined illumination range.

Since the light source module 130 is disposed on the lower surface 110*b* of the upper casing 110, the thermal conduction path between the light source module 130 and the outer surface 110*u* of the upper casing 110 is short and basically equivalent to the thickness of the upper casing 110, such that the heat generated by the light source module 130 can be quickly conducted to the outer surface 110*u* of the upper casing 110 and further dissipated to the atmosphere. Since the illumination device 100 already provides a short thermal conduction path, the upper casing 110 does not need to have any additional thermal openings, and external impurities or liquid will not enter the illumination device 100.

Besides, the upper casing 110 further includes a plurality of thermal fins 111 whose end faces define the lower surface 110*b* of the upper casing 110. That is, the light source module 130 is disposed on the end faces of the thermal fins 111, and the heat generated by the light source module 130 is conducted to the outer surface 110*u* of the upper casing 110 through the thermal fins 111. In another embodiment, the thermal fins 111 can be omitted, the material of the upper casing 110 has excellent thermal conduction, and the heat generated by the light source module 130 is conducted to the outer surface 110*u* through the upper casing 110 which has a certain thickness.

As indicated in FIG. 2, the transparent bottom casing 120 can be fixed on the upper casing 110 by using at least one fixing element 125. The fixing element 125 can be realized by such as screws. The angle A1 included between the upper surface 120*u* of the transparent bottom casing 120 and the lower surface 110*b* of the upper casing 110 is an acute angle. If the upper surface 120*u* of the transparent bottom casing 120 is substantially horizontal, then the lower surface 110*b* of the upper casing 110 is an inclined surface, and the light source module 130 disposed thereon is inclined.

As indicated in FIG. 2, the light source module 130 includes a circuit board 131 and a plurality of light sources 132 disposed on the circuit board 131 and electrically connected to the circuit board 131. The circuit board 131 is disposed on the lower surface 110*b* of the upper casing 110 and contacts the thermal fins 111. The light sources 132 can be realized by such as light emitting diodes. The direction of the optical axis X1 of the light emitted by the light sources 132 intersects with the first reflection layer 140, such that the light emitted by each light source 132 can enter the first reflection layer 140. The emitted light can be reflected by the first reflection layer 140 and outputted from the transparent bottom casing 120 to provide illumination. The light sources 132 can be disposed adjacent to the first reflection layer 140, such that the optical axis X1 of each light source 132 intersects with the first reflection layer 140.

Refer to FIG. 2. The first reflection layer 140 has several sections of reflective surface. In the present embodiment, the first reflection layer 140 is formed of two sections of reflective planes. The two reflective surfaces form different angles with the normal direction N1 of the upper surface 120*u*. For example, the first reflection layer 140 has a first reflective surface 140*s*1 and a second reflective surface 140*s*2, wherein the angle A21 between the first reflective surface 140*s*1 and the normal direction N1 is different from the angle A22 between the second reflective surface 140*s*2 and the normal direction N1. Through the design of several sections of reflective surface, the optical axis X1 of each light source 132 intersects with the first reflection layer 140. The light reflected from the first reflection layer 140 will be directly outputted from the transparent bottom casing 120 without being further reflected by the upper casing 110 (second reflection will reduce the brightness of the light). Thus, the illuminating brightness of the illumination device 100 can be increased. However, the first reflection layer 140 also can be realized by a curved reflective surface formed of more than one reflective surface having different curvatures.

Figure 3:
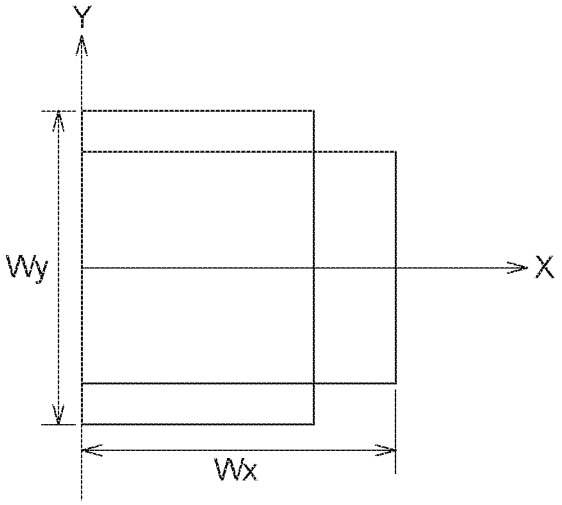
FIG. 3 is a schematic diagram of an illumination range of the illumination device of FIG. 2.

As indicated in an enlarged view of FIG. 2, the first light source 1321 of the light sources 132 is closer to the first reflection layer 140, and the angle A21 between the first reflective surface 140*s*1 of the first reflection layer 140 and the normal direction N1 can be designed as negative (the direction proceeding towards the first reflective surface 140*s*1 from the normal direction N1 is clockwise, and the value is defined as negative). The angle A21 can be an acute angle, such that the light emitted by the first light source 1321 is reflected by the first reflective surface 140*s*1 and directly outputted from the transparent bottom casing 120 rather than being reflected to the light source module 130 or other parts of the upper casing 110. FIG. 3 is a schematic diagram of an illumination range of the illumination device 100 of FIG. 2. The smaller the angle A21 is, the farther the reflected light L1 can be projected along a front direction (such as the +X axis), and the wider the illuminating width Wx along the front direction will be.

As indicated in FIG. 2, the second light source 1322 of the light sources 132 is farther away from the first reflection layer 140, and the angle A22 between the second reflective surface 140*s*2 of the first reflection layer 140 and the normal direction N1 can be designed as positive (the direction proceeding towards the second reflective surface 140*s*2 from the normal direction N1 is anti-clockwise, and the value is defined as positive). The angle A22 can be an acute angle, such that the light emitted by the second light source 1322 is reflected by the second reflective surface 140*s*2 and directly outputted from the transparent bottom casing 120. The larger the angle A22 is, the more likely the light L2 is reflected to the light source module 130 or other parts of the upper casing 110 by the second reflective surface s2 and the light L2 will be reflected again by the light source module 130 or the upper casing 110 to be outputted from the transparent bottom casing 120. Such design of second reflection will reduce the brightness of the light, therefore the magnitude of the angle A22 must be appropriately designed. As indicated in FIG. 3, through suitable design of the angle A22, the reflected light L2 can be projected to a farther distance along the front direction (such as the +X axis) and make the illuminating width Wx larger.

Through the first reflection layer 140 and the inclined light source module 130, the entire illumination range is formed of a light reflected by the first reflection layer 140 to be outputted from the transparent bottom casing 120 and a direct light directly entering the transparent bottom casing 120 from the light sources 132.

As indicated in FIG. 2, the first reflection layer 140 can be realized by a coating layer formed on the inner board 150. Or, the first reflection layer 140 can be realized by a reflective mirror used as a partition board dividing the inner space of the illumination device 100. Under such design, the illumination device 100 can selectively omit the inner board 150 and directly use the first reflection layer 140 as a partition board.

As indicated in FIG. 2, there is a first space SP1 among a front section of the upper casing 110, the first reflection layer 140 and a front section of the transparent bottom casing 120, wherein the light source module 130 is disposed in the first space SP1. The light emitted by the light source module 130 is outputted from the illumination device 100 through the first space SP1. There is a second space SP2 among a rear section of the upper casing 110, the first reflection layer 140, a rear section of the transparent bottom casing 120 and the rear casing 155, wherein the control module 160 is disposed in the second space SP2. The rear casing 155 connects the upper casing 110 and the transparent bottom casing 120. The control module 160 is electrically connected to the light source module 130 for controlling the emission of the light sources 132.

Figure 4:
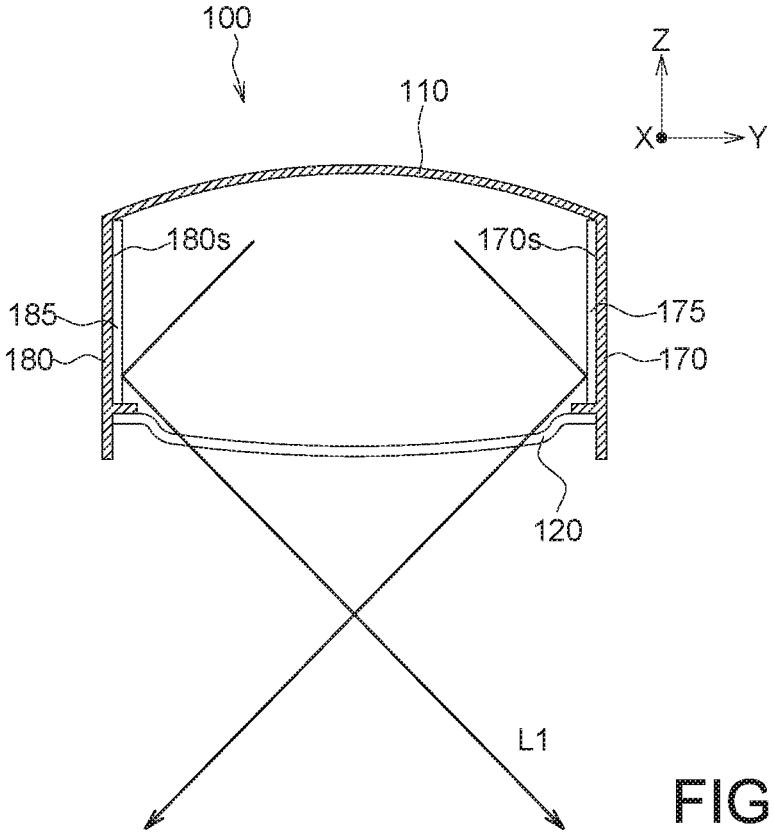
FIG. 4 is a cross-sectional view of the illumination device of FIG. 1 along a direction 3-3'.

FIG. 4 is a cross-sectional view of the illumination device 100 of FIG. 1 along a direction 3-3'. The illumination device 100 further includes a first side casing 170, a second reflection layer 175, a second side casing 180 and a third reflection layer 185. The first side casing 170 is extended between the upper casing 110 and the transparent bottom casing 120. The first side casing 170 has a first inner lateral surface 170*s*, and the second reflection layer 175 is disposed on the first inner lateral surface 170*s* for reflecting the light emitted by the light source module 130. The second side casing 180 is disposed opposite to the first side casing 170 and extended between the upper casing 110 and the transparent bottom casing 120. The second side casing 180 has a second inner lateral surface 180*s*, and the third reflection layer 185 is disposed on the second inner lateral surface 180*s* for reflecting the light emitted by the light source module 130.

Refer to FIG. 4. Due to the design of the second reflection layer 175 and the third reflection layer 185, after the light L1 emitted by the light source module 130 is reflected by the second reflection layer 175 and the third reflection layer 185, the reflected light is projected to a farther distance along two lateral directions of the illumination device 100 (such as the ±Y axis and the −Y axis). As indicated in FIG. 3, the reflected light L1 can be projected to a farther distance along two lateral directions, such that a larger illuminating width Wy can be obtained along the two lateral directions.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An illumination device, comprising:

an upper casing having a lower surface;

a transparent bottom casing having an upper surface;

a light source module disposed on the lower surface of the upper casing; and a first reflection layer directly connected to the lower surface of the upper casing and the upper surface of the transparent bottom casing for reflecting the light emitted by the light source module, wherein the light source module comprises a plurality of light sources, an optical axis direction of each light emitted from the plurality of light sources directly intersects with the first reflection layer, wherein the upper casing further includes a plurality of thermal fins whose end faces define the lower surface of the upper casing and the light source module is disposed on the end faces of the thermal fins.

2. The illumination device according to claim 1, wherein the plurality of light sources are disposed adjacent to the first reflection layer.

3. The illumination device according to claim 1, wherein the light source module is directly disposed on the lower surface.

4. The illumination device according to claim 1, wherein an acute angle is included between the upper surface and the lower surface.

5. The illumination device according to claim 1, further comprising:

a first side casing connecting between the upper casing and the transparent bottom casing and having a first inner lateral surface; and a second reflection layer disposed on the first inner lateral surface for reflecting the light emitted by the light source module.

6. The illumination device according to claim 5, further comprising:

a second side casing disposed opposite to the first side casing, connecting between the upper casing and the transparent bottom casing and having a second inner lateral surface; and a third reflection layer disposed on the second inner lateral surface for reflecting the light emitted by the light source module.

7. The illumination device according to claim 1, wherein there is a first space among a front section of the upper casing, the first reflection layer and a front section of the transparent bottom casing, and the light source module is disposed in the first space.

8. The illumination device according to claim 1, further comprising:

a rear casing, wherein there is a second space among the first reflection layer, a rear section of the upper casing and a rear section of the transparent bottom casing; and a control module disposed within the second space for controlling the light source module.

9. The illumination device according to claim 1, wherein the first reflection layer has a plurality of plane reflective surfaces forming different angles with a normal direction of the upper surface.

10. The illumination device according to claim 1, wherein the first reflection layer has a curved reflective surface formed of more than one reflective surface having different curvatures.

11. The illumination device according to claim 1, wherein the upper surface of the transparent bottom casing is horizontal and the lower surface of the upper casing is an inclined surface with respect to the upper surface of the of the transparent bottom casing.

* * * * *